United States Patent [19]

Tseng

[11] 4,445,347

[45] May 1, 1984

[54] PADLOCK

[76] Inventor: Chih-Shan Tseng, No. 10-3, Cheng Shin, Pin Tung, Taiwan

[21] Appl. No.: 278,055

[22] Filed: Jun. 29, 1981

[51] Int. Cl.[3] ..... E05B 67/22

[52] U.S. Cl. ..... 70/38 B; 70/386; 70/421

[58] Field of Search ..... 70/38 R, 38 A, 38 B, 70/38 C, 386, 421, 404, 419

[56] References Cited

U.S. PATENT DOCUMENTS

| | | | |
|---|---|---|---|
| 1,477,318 | 12/1923 | Crass | 70/404 |
| 1,983,747 | 12/1934 | Gahagan | 70/38 B |
| 3,221,526 | 12/1965 | Stackhouse | 70/38 A |
| 4,341,102 | 7/1982 | Ku | 70/421 |

FOREIGN PATENT DOCUMENTS

| | | | |
|---|---|---|---|
| 906230 | 5/1945 | France | 70/38 B |
| 413960 | 8/1945 | Italy | 70/38 B |
| 718451 | 11/1954 | United Kingdom | 70/421 |

*Primary Examiner*—Robert L. Wolfe

*Attorney, Agent, or Firm*—Larson and Taylor

[57] ABSTRACT

A padlock is provided with bidirectional locking pins so that a key can be turned in either direction to operate the padlock. The padlock has a circular slot in the bottom portion to allow the insertion of a cylindrical key which has teeth and recesses corresponding with the lock pins. A locking ball holds a U-shaped lock bar in place. When the key is turned the ball moves inwardly to release the lock bar and to unlock the padlock. Turning the key in the opposite operation will lock the padlock.

15 Claims, 7 Drawing Figures

PADLOCK

FIELD OF THE INVENTION

The present invention relates to a padlock.

BACKGROUND OF THE INVENTION

The conventional padlock is provided with a cylinder which can be turned inside a lock body. On both the lock body and the cylinder are located corresponding pin holes for receiving springs and two sections of lock pins. The lock pins keep the cylinder from turning because of a difference in their length. A well matched key can move the lock pin, thus separating the lock body and the cylinder. The cylinder can then be turned, permitting a lock bar to move upwardly, thereby uplocking the padlock.

The structure of such a conventional lock is too easily unlocked.

SUMMARY OF THE INVENTION

The present invention is directed to a type of lock that removes the above described drawnback and disadvantage.

According to the present invention, a padlock comprising a lock body, lock barrel and lock barrel elements is provided. The lock body is provided with lock pins on its inside which are located in two different directions. The pins are controlled by a key having recesses and lock teeth corresponding to the lock pins. In a particular embodment of a padlock according to the present invention, the key is provided at the top end with four recesses and four lugs for corresponding with lock pins when the key is put into the padlock.

DESCRIPTION OF THE PREFERRED EMBODIMENT

Figure 1:
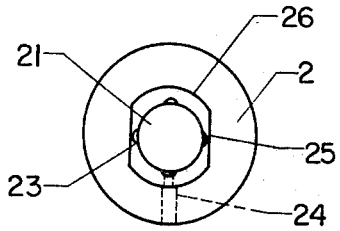
FIG. 1 is a top plan view of one embodiment of a lock barrel of a padlock according to the present invention.

With reference to the drawings, a padlock according to one embodiment of the present invention comprises a lock body 1, a lock barrel 2, a ball 3, and a lock bar 4. A key 5 is used to operate the padlock.

Figure 4:
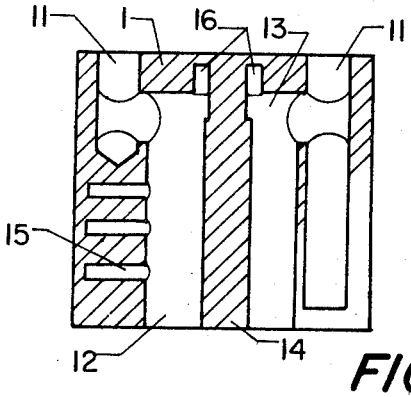
FIG. 4 is a cross-sectional view of a lock body of the padlock.
Figure 6:
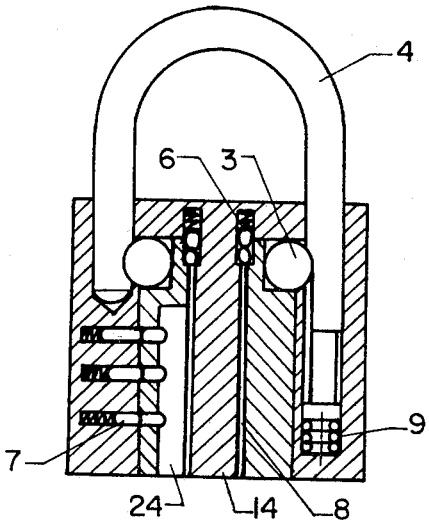
FIG. 6 is a cross-sectional view of the padlock according to the present invention shown in the lock position.

The lock body 1 can be made of a copper material. With reference to FIG. 4, lock body 1 has two recesses 11 at the top end to receive lock bar 4 upon assembly. Provided in the central portion of lock body 1 is an annular, circular hole 12 for receiving lock barrel 2, and a central guide bar 14 for guiding the insertion of key 5. In the upper ends of hole 12 there is a slot 13 connecting with recess 11 and which can receive two balls 3 as shown in FIG. 6 that can move along slot 13. In the side and upper end of lock body 1 are provided pin holes 15 and 16, respectively, to guide the insertion of corresponding pins 7 and 6, as shown in FIG. 6.

Figure 2:
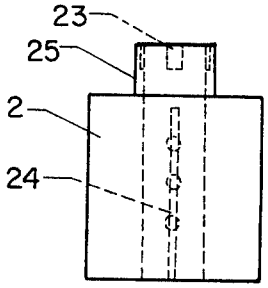
FIG. 2 is a front elevational view of the lock barrel.
Figure 3:
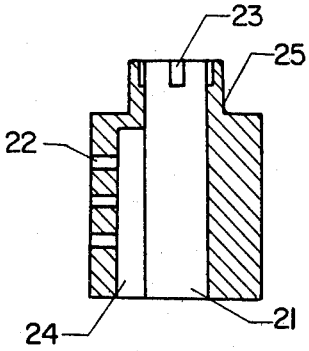
FIG. 3 is a cross-sectional view taken through the right side of the lock barrel.
Figure 5:
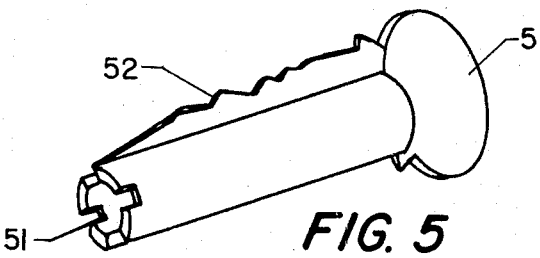
FIG. 5 is a perspective view of a key.
Figure 7:
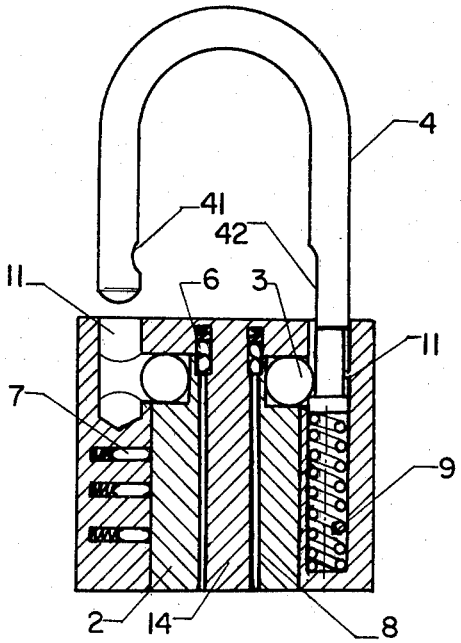
FIG. 7 is a cross-sectional view of the padlock shown in the unlocked position.

Lock barrel 2 is cylindrical as shown in FIGS. 1, 2 and 3. Lock barrel 2 is provided with a central, circular hole 21, the diameter of which is larger than the outer diameter of guide bar 14 of lock body 1. Thus, after assembly of lock barrel 2 into lock body 1, a circular gap 8 is provided to enable the insertion of key 5. The lock barrel 2 has pin holes 22 and 23 in the side and upper end thereof, respectively, which correspond with the lock pin holes 15 and 16 of lock body 1. This enables the control of the movement of corresponding lock pin 6 and 7 (as in the conventional padlock principle). As shown in FIGS. 3, 6 and 7, in the peripheral portion of circular hole 21 is a slot 24 provided to enable the insertion of teeth 52 of key 5 (FIG. 5). Furthermore, lock barrel 2 has a smaller diameter portion 26 that is provided with two surfaces 25 (as shown in FIG. 1) to control the movement of balls 3 when installed, as shown in FIG. 6.

Key 5 is comprised of a hollow cylinder, having four recesses 51 at the top end which define four lock lugs, and having lock teeth 52 along one side. Teeth 52 are cut to correspond to lock pins 7 and the lock lugs correspond to pins 6 such that pins 7 and 6 are respectively raised as key 5 is inserted into lock body 1.

The padlock according to the present invention is shown assembled in FIG. 6. Lock bar 4 is generally "U"-shaped having one leg longer than the other. A recess 41 (FIG. 7) is provided in the shorter leg for engaging a ball 3 when in the locked position. A second recess 42 is provided in the longer leg for engaging the other ball 3. A spring 9 engages the end of the longer leg to urge lock bar 4 upwardly when unlocked.

To unlock the padlock, key 5 is put into the circular gap 8. Thus, key 5 engages lock pins 6 and 7 thereby permitting the turning of lock barrel 2 in the right or left direction. When key 5 is turned, the balls 3 move inwardly into the two surfaces 25 of the lock barrel 2. This releases lock bar 4 which is moved in the upward direction by spring 9. The one ball 3 that engages the longer leg of lock bar 4 cannot move inwardly entirely. Thus, the upward movement of lock bar 4 is limited to prevent the escape of lock bar 4 from lock body 1, but the opening of the padlock is still permitted.

To lock the padlock, the opposite operation is performed. Key 5 turns lock barrel 2 in the left or right direction which forces balls 3 outwardly into recesses 41 and 42 of lock bar 4 to close the padlock.

I claim:

1. A padlock comprising a lock body that includes an internally located, axially extending guide bar and an annular bore through one end of said lock body, said bore being closed at its inner end and defined by said guide bar and inner walls of said lock body, a first plurality of pin holes in said lock body inner wall axially spaced therealong and in communication with said annular bore, a second plurality of pin holes in said lock body located radially spaced around said closed end of said annular bore and in communication therewith, a slot located outside said bore adjacent said closed end thereof and in communication therewith, and a first and second recess in the other end of said lock body;

a U-shaped lock bar having a shorter leg and a longer leg, said longer leg thereof being resiliently mounted in said first lock body recess and movable between an open, unlocked position and a closed, locked position, said shorter bar leg having a notch on the inward side near the end thereof;

a locking element movable in said lock body slot for engaging said lock bar notch when in the closed position;

a cylindrical lock barrel mounted for rotation in either direction in said lock body annular bore, said lock barrel including a central bore completely therethrough and defined by inner walls, the diameters of said central bore and said guide bar being selected so as to provide an annular gap between said guide bar and said lock barrel inner walls for receiving a matching key having radially extending lock teeth, an axially extending slot in radial communication along the inner side with said central bore, said lock barrel slot for receiving the lock teeth of the key, a first plurality of pin holes extending radially completely through said lock barrel walls, and axially and radially located so as to be in communication between corresponding ones of said first plurality of lock pin holes and said barrel slot, and a second plurality of pin holes extending axially in the barrel inner walls at the barrel end adjacent the closed end of said lock body, said second plurality of pin holes being in communication with corresponding ones of said second body pin holes when said barrel is in an aligned position;

a first set of resiliently mounted pins in corresponding ones of said first plurality of body and barrel pin holes; and a second set of resiliently mounted pins in corresponding ones of said second plurality of body and barrel pin holes.

2. In combination with said padlock as claimed in claim 1, a key having a cylindrical body with a bore therein and having radially extending lock teeth mounted axially on said key body, one end of said key body having a plurality of recesses, said teeth and said key recesses for corresponding with said first set of pins and said second set of pins, respectively, when the key is inserted in said padlock, said key bore having a diameter so as to be able to receive said guide bar and said key body having a diameter and wall thickness so as to be able to be received in said annular gap.

3. The padlock as claimed in claim 1 wherein said lock barrel further includes integral larger and smaller diameter portions in coaxial alignment, and a radial ledge where said portions joined, said ledge forming a raceway with said lock body slot, and wherein said locking element comprises a ball mounted in said raceway.

4. The padlock as claimed in claim 3 wherein said lock barrel smaller diameter portion includes a flat section axially extending from the juncture with said larger diameter portion; and wherein when said ball abuts said flat section, said lock bar can be withdrawn, and when said ball does not abut said flat section, said ball is forced into engagement in said lock bar notch and said lock bar can not be withdrawn.

5. The padlock as claimed in claim 4 wherein said lock barrel smaller portion includes two flat sections on opposite sides thereof; and said padlock further including a second ball in said raceway for engaging a notch in the longer leg of said lock bar for retaining said lock bar in said lock body when the shorter leg is removed therefrom.

6. A padlock comprising a lock body that includes a closed first end, a bore defined by inner walls of said body extending through an opposite second end, a radial wall extending across said bore, a first plurality of pin holes in said lock body inner wall axially spaced therealong and in communication with said bore, at least one, second pin hole in said lock body located in said radial wall and in communication with said bore, a slot located outside said bore adjacent said closed first end and in communication with said bore, and a first and a second axial recess in said closed first end;

a U-shaped lock bar having a shorter leg and a longer leg, said longer leg thereof being resiliently mounted in said first lock body recess and movable between an open, unlocked position and a closed, locked position, said shorter bar leg having a notch on the inward side near the end thereof;

a locking element movable in said lock body slot for engaging said lock bar notch when in the closed position;

a cylindrical lock barrel mounted for rotation in said lock body bore, said barrel including a central bore defined by inner barrel walls and by a first barrel end wall, said end wall being adjacent said body closed end when said barrel is mounted in said body, an axially extending slot in radial communication along the inner side with said central bore, said barrel bore for receiving a matching key having radially extending lock teeth and said barrel slot for receiving the lock teeth, a first plurality of pin holes extending radially completely through said lock barrel walls, and axially and radially located so as to be in communication between corresponding ones of said first plurality of lock body pin holes and said barrel bore when said barrel is in an aligned position, and at least one, second pin hole extending axially in said barrel end wall and in communication with said at least one body second pin hole when said barrel is in an aligned position;

a first set of resiliently mounted pins in corresponding ones of said first plurality of body and barrel pin holes; and at least a second resiliently mounted pin in said second body and barrel pin holes.

7. A padlock as claimed in claim 6 and further including a guide bar rigidly mounted to at least one of said barrel and said lock body so as to extend axially into said barrel central bore and to define an annular gap between said guide bar and said barrel inner walls.

8. A padlock as claimed in claim 7 wherein said guide bar is rigidly mounted to said lock body and said barrel central bore extends completely through said barrel.

9. A padlock as claimed in claim 8 wherein said lock body radial wall comprises the inner side of said body closed first end.

10. In combination with said padlock as claimed in claim 7, a key having a cylindrical body with a bore therein and having radially extending lock teeth mounted axially on said key body, one end of said key body having at least one recess, said teeth and said key recess for corresponding with said first set of pins and said second set of pins, respectively, when the key is inserted in said padlock, said key bore having a diameter so as to be able to receive said guide bar and said key body having a diameter and wall thickness so as to be able to be received in said annular gap.

11. The padlock as claimed in claim 6 wherein said lock barrel further includes integral larger and smaller diameter portions in coaxial alignment, and a radial ledge where said portions joined, and wherein said locking element comprises a ball.

12. The padlock as claimed in claim 11 wherein said ledge forms one axial side of a raceway, wherein said lock body radial wall comprises the inner side of said body closed first end and forms the other axial side of said raceway, and wherein said ball is mounted in said raceway.

13. The padlock as claimed in claim 12 wherein said lock barrel smaller diameter portion includes a flat section axially extending from the juncture with said larger diameter portion; and wherein when said ball abuts said flat section, said lock bar can be withdrawn, and when said ball does not abut said flat section, said ball is forced into engagement in said lock bar notch and said lock bar can not be withdrawn.

14. The padlock as claimed in claim 13 wherein said lock barrel smaller portion includes two flat sections on opposite sides thereof; and said padlock further including a second ball in said raceway for engaging a notch in the longer leg of said lock bar for retaining said lock bar in said lock body when the shorter leg is removed therefrom.

15. The padlock as claimed in claim 6 wherein said inner body walls are integral with said body and said body is a one piece integral structure.

* * * * *